United States Patent [19]

van de Ven

[11] Patent Number: 4,472,826

[45] Date of Patent: Sep. 18, 1984

[54] X-RAY EXAMINATION APPARATUS

[75] Inventor: Johannes T. A. van de Ven, Eindhoven, Netherlands

[73] Assignee: U.S. Philips Corporation, New York, N.Y.

[21] Appl. No.: 468,232

[22] Filed: Feb. 22, 1983

[30] Foreign Application Priority Data

Mar. 3, 1982 [NL] Netherlands ..... 8200852

[51] Int. Cl.[3] ..... H05G 1/30; H05G 1/36

[52] U.S. Cl. ..... 378/099; 358/111; 378/97; 378/108

[58] Field of Search ..... 378/97, 99, 108, 99, 378/96, 111

[56] References Cited

U.S. PATENT DOCUMENTS

| | | | |
|---|---|---|---|
| 2,441,324 | 5/1948 | Morgan et al. | 378/97 |
| 4,044,264 | 8/1977 | Lutz et al. | 378/97 |
| 4,171,484 | 10/1979 | Hunt | 378/108 |
| 4,335,307 | 6/1982 | De Vries et al. | 378/97 |

FOREIGN PATENT DOCUMENTS

| | | | |
|---|---|---|---|
| 0038666 | 10/1981 | European Pat. Off. | 378/97 |

*Primary Examiner*—Afred E. Smith
*Assistant Examiner*—T. N. Grigsby
*Attorney, Agent, or Firm*—Paul R. Miller

[57] ABSTRACT

In an X-ray examination apparatus comprising an image intensifier tube and an optical light distribution system there is included an image field selector, by means of which, using a subbeam diverted from the imaging beam, a measurement field can be selected and by means of which this measurement field or a boundary outline thereof can be projected back into the imaging radiation path. Thus, it is achieved that during an examination stage an indication of the extent and location of a measurement field which is considered to be relevant for controlling the desired exposure for pictures to be produced, can be constantly displayed on the image screen of the television monitor.

15 Claims, 2 Drawing Figures

X-RAY EXAMINATION APPARATUS

Figure 1:
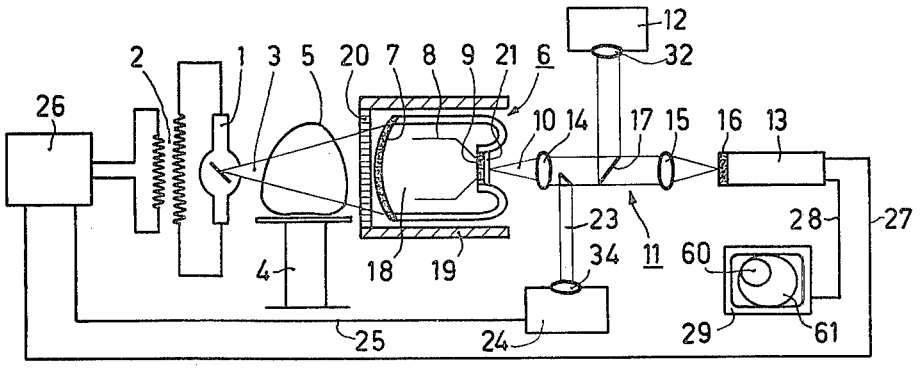

The invention relates to an X-ray examination apparatus comprising an X-ray image intensifier tube and an optical image transmission system arranged after the exit screen of this tube in the path of an image-carrying light beam and comprising a beam splitter for projecting an output image on a hard-copy device and a television camera tube, respectively, and a light extracting device arranged in the optical path for controlling a brightness control device.

Such an X-ray examination apparatus is known from GB Pat. No. 1,237,007. In an apparatus described therein, the light intercepted by the light extracting device is used to adapt the brightness of the exit screen to the image frequency of a film camera. Furthermore, a diaphragm arranged in the light beam in front of the television camera tube is adapted to brightness variations of the exit screen.

The invention has for its object to provide such an X-ray examination apparatus with an image field selector, by means of which an arbitrary subregion of the exit screen can be selected for brightness control without adversely affecting image formation for the television circuit or the hard-copy device. As a result, an optimum exposure can be attained for the most interesting subregion of the screen image, while avoiding control effects from the light content of less interesting regions.

According to the invention, an X-ray examination apparatus of the kind mentioned in the preamble is therefore characterized in that the light extracting device arranged in the beam path of an imaging light beam directs a subbeam containing image information from the whole of the exit screen out of the beam path, and a measurement field selector including a light detector for measuring the luminous flux within a measurement field determined by the measurement field selector, is located in the path of the subbeam.

In an apparatus according to the invention, a measurement field can be adjusted without the means used for this purpose adversely affecting the imaging beam. Also when the measurement field is exchanged, the imaging process proper is not adversely affected.

In a preferred embodiment according to the invention, the light extracting device comprises a prism, a mirror which may be semi-transparent, or a bundle of optical fibres. Such an element has only a comparatively small radiation-intercepting surface and will therefore receive only a small part of the luminous intensity of the imaging beam. Due to the fact that this element is arranged in the optical path in a region in which the image-forming beam is parallel, the light extracting device, small as it may be, will nevertheless be able to produce an image of the whole exit screen.

In a preferred embodiment, the measurement field selector comprises a measurement field diaphragm plate which is arranged so as to be displaceable at right angles to the radiation beam deflected by the light extracting device. In this case, there may be provided a measuring device that can be controlled by the movement of the measurement field plate for measurement field selection and control of the selected measurement field. This measurement device may be, for example, a simple potentiometer.

In a further preferred embodiment, there is provided behind the measurement field selector a light source which projects a light beam through the selected measurement field diaphragm onto the exit screen of the X-ray image intensifier tube. In this case, use is made of the reversibility of the beam path in an optical system.

The selected measurement field is now imaged on the exit screen and is therefore also displayed through the television camera tube, for example, on a monitor connected thereto. As a result, the radiologist is able to observe continually, without interrupting the examination, whether the selected measurement field contains the most relevant parts of the image. It is alternatively possible to display only the relevant boundary of a measurement field on the exit screen.

In a further preferred embodiment, a collimator-measurement field selector, known per se from U.S. Pat. No. 3,839,634, is arranged in the beam path after the optical element. Since the latter is now arranged outside the imaging beam proper, there is a considerably greater degree of freedom in the construction and the geometry of the collimator, and image formation will not be adversely affected. Similarly, in this case also, the selected measurement field can be projected onto the exit screen and during an examination.

For radiographic purpose, it is generally desirable to switch off the light source for imaging the measurement field. This prevents light originating therefrom from being intercepted by the light detector, which is preferably a photodiode. When the selected measurement field is used as a reference, the correct exposure can be adjusted, for example, by selecting the width of the X-ray pulse employed to produce the radiogram.

Figure 2:
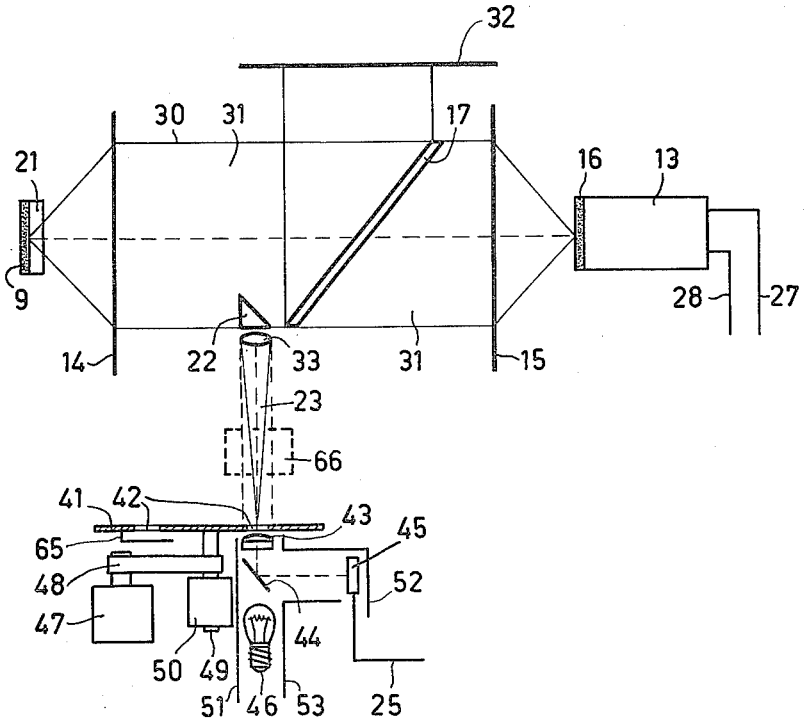

A few preferred embodiments according to the invention will now be described with reference to the drawing. In the drawing:

FIG. 1 shows in schematic form an X-ray examination apparatus in accordance with the invention and FIG. 2 shows a preferred measurement field selection device to be used therein.

An X-ray examination apparatus as shown in FIG. 1 comprises an X-ray tube 1 having a supply source 2 for producing an X-ray beam 3 by means of which an object 5 disposed on a support 4 can be irradiated. The image-carrying X-ray beam is intercepted by an X-ray image intensifier tube 6 having an entrance screen 7, an electron-optical system 8 and an exit screen 9. An image-carrying light beam 10 emanating from the exit screen is imaged by means of an optical imaging system 11 onto a film camera 12 and onto a television camera tube 13. The optical imaging system comprises in the usual manner a first lens 14, the object focal plane of which coincides with the exit screen 9, a second lens 15, the image focal plane of which coincides with a target plate 16 of the television camera tube 13, and an image distribution device 17, for example, a semitransparent and/or pivotable mirror, which is interposed between the two lenses and by means of which the light beam can also be projected onto the film camera 12. In order to avoid the disturbing effects of, for example, electromagnetic fields of an electron beam 18, which images photo-electrons from the entrance screen onto the exit screen, the X-ray image intensifier tube is accommodated in a housing 19 having, for example, a strip-shaped entrance grid 20, which according to U.S. Pat. No. 4,220,890 may fulfil the function of both a stray-radiation grid and a magnetic shield.

In the chosen arrangement of the lens 14, the light beam 10 originating at the exit screen and emitted through an exit window 21, is formed into a parallel beam between the two lenses. There is interposed between the two lenses an optical element 22 by means of which a part 23 of the imaging beam is deflected out of the path of the imaging beam. In this case, the optical element 22 has the form of a prism, by means of which, for example, 0.1 to 1% of the luminous flux from the imaging beam is intercepted. As has already been stated, the optical element 22 may alternatively be constituted by a mirror, which is arranged at approximately 45° and which may be semitransparent, or by a bundle of optical fibres together with an imaging lens. The prism 22 directs the beam 23 towards a measurement field selection device 24, from which a control device 26 for the supply of the X-ray tube can be controlled through a lead 25. The control device may be further controlled by a signal which may be derived through a lead 27 from the television camera tube. A television monitor 29 is connected by means of a lead 28 to the television camera tube.

In FIG. 2, the first lens 14, the second lens 15 and the beam splitter 17 of an optical imaging system 11 are shown. The image-carrying beam 10 (FIG. 1) is collimated by the lens 14 into a parallel beam 30, which forms an image of the exit screen via an optical path 31 through the beam splitter 17 and a camera lens 32 on recording means, for example, a film of a film camera 12, and forms an image of the exit screen through the lens 15 on the target plate 16 of the television camera tube 13. The exit screen 9 of the X-ray image intensifier tube is normally a fluorescent screen in which the electron image is converted into a luminous image. Such a screen is constructed so that in this case it can be considered without objection as the object plane for the image. The exit window is then assumed to be an optically transparent plano-parallel plate and as such does not disturb the image, apart from a modification of the optical path length. This also applies in relation to a tube having a fibreoptic exit window. Also in this case, no problems are encountered for the image proper. It is desirable for the optical irradiation of a measuring field still to be described that the exit screen should reflect light in a sufficiently diffuse manner so that such a reflection can form a suitable object for the imaging system. This requirement is amply fulfilled by the usual form of screen. FIG. 2 shows the prism 22, possibly with a lens 33, a measurement field disk 41 arranged in the optical path of the light beam 23, a lens 43 arranged behind a selected measurement field diaphragm aperture 42, a semitransparent mirror 44, a photodetector 45 with a lead-out conductor 25 and a light source 46 of a measurement field selector-light measuring device in accordance with the invention. By means of a driving motor 47 and a driving pulley 48, the measurement field disk can here be rotated about a shaft 49 about which a position measuring device 50 is also arranged. Shields 51, 52 and 53 prevent light originating from the exit screen 9 from being intercepted by the photodetector 45. The lens 33 forms in the region of the measurement field disk, an image of the exit screen 9 within which the selected measurement field diaphragm aperture 42 selects a desired measurement field. Light incident within this measurement field is focussed by means of the lens 43 and the mirror 44 onto the photodetector 45. Signals obtained from the photodetector, which is preferably consituted by a photodiode, can be used for timing the exposure of an image to be recorded. By rotation of the measurement field disk, a different measurement field diaphragm aperture can be arranged in the beam 23. By means of the light source 46, the selected measurement field diaphragm aperture can be projected onto the exit screen in the manner already described. From there, the selected measurement field is also displayed on the monitor 29. The measurement field 60 appears thereon as an illuminated region within an image 61 of the whole exit screen. During image-recording, the measurement field need no longer be checked and the light source 46 can therefore be switched off.

If desired, the boundary outline of the measurement field may be illuminated by using exchangeable or displaceable outline masks 65 arranged in proximity to suitable measurement field diaphragm apertures 42. As a result, any disturbance of the image as a result of the illumination of the boundary outline is prevented. The quantity of light required to be emitted to illuminate the outlines of measurement fields, can be extremely small.

In an otherwise similar manner, instead of the measurement field disk 41, a collimator-measurement field selector device 66 of the kind described in U.S. Pat. No. 3,839,634 may be arranged in the light beam 23, which must then have the same optical radiation path as the beam 30, between the lenses 14 and 15. In this embodiment, the lens 33 is therefore not present. By rotation or by tilting of such a collimator-measurement field selector device, also in this case a desired measurement field can be adjusted and the measurement field can again be displayed on the monitor. Unfavourable influencing of the picture proper by the collimator-measuring field selector device, which would occur when a controllable diaphragm is used is now prevented.

What is claimed is:

1. An X-ray examination apparatus comprising an X-ray image intensifier tube having an exit screen and an optical beam transmission system arranged after said exit screen in the path of an image-carrying light beam, said optical beam transmission system comprising beam splitting means for projecting an output image onto a hard-copy device in one direction and onto a television camera tube in a second direction, and light-extracting means arranged in the light beam path for controlling a brightness control device, characterized in that said light extracting means directs a subbeam containing image information from the whole of said exit screen into a third direction out of said light beam path, and said light extracting means comprising a measurement field selector and a photodetector means for measuring luminous flux within a measurement field determined by said measurement field selector, said measurement field selector and said photodetector means being located in a light path of said subbeam, and a light source means located outside said light path for projecting said measurement field determined by said measurement field selector onto said exit screen of said image intensifier tube.

2. An X-ray examination apparatus according to claim 1, wherein said measurement field selector is constituted by a measurement field diaphragm plate arranged at an image of said exit screen formed by a lens and measurement field diaphragm apertures, one of said apertures being movable into and out of said subbeams.

3. An X-ray examination apparatus according to claim 1, wherein a measurement field selecting adjustable collimator system is arranged in the path of an uncollimated subbeam.

4. An X-ray examination apparatus according to claim 1, wherein said light extracting means includes one of a prism, a mirror, or a bundle of optical fibers.

5. An X-ray examination apparatus according to claim 4, wherein a measurement field selecting adjustable collimator system is arranged in the path of an uncollimated subbeam.

6. An X-ray examination apparatus according to claim 5, wherein said light extracting means includes second beam splitting means for directing light from said exit screen toward said photodetector means and for directing light from said light source means toward said exit screen.

7. An X-ray examination apparatus according to claim 5, wherein an adjusting system is provided for fixing the position of a measurement field to be selected.

8. An X-ray examination apparatus according to claim 4, wherein said measurement field selector is constituted by a measurement field diaphragm plate arranged at an image of said exit screen formed by a lens and measurement field diaphragm apertures, one of said apertures being movable into and out of said subbeam.

9. An X-ray examination apparatus according to claim 8, wherein said measurement field selector is provided with means for projecting a measurement field boundary outline onto said exit screen.

10. An X-ray examination apparatus according to claim 8, wherein said light extracting means includes second beam splitting means for directing light from said exit screen toward said photodetector means and for directing light from said light source means toward said exit screen.

11. An X-ray examination apparatus according to claim 8, wherein an adjusting system is provided for fixing the position of a measurement field to be selected.

12. An X-ray examination apparatus according to claim 8, wherein said measurement field diaphragm plate is a rotatable disk having apertures arranged in an annular region.

13. An X-ray examination apparatus according to claim 12, wherein said measurement field selector is provided with means for projecting a measurement field boundary outline onto said exit screen.

14. An X-ray examination apparatus comprising an X-ray image intensifier tube having an exit screen and an optical beam transmission system arranged after said exit screen in the path of an image-carrying light beam, said optical beam transmission system comprising a beam splitting means for projecting an output image onto a hard-copy device in one direction and onto a television camera tube in a second direction, and light extracting means arranged in the light beam path for controlling a brightness control device, characterized in that said light extracting means directs a subbeam containing image information from the whole of said exit screen into a third direction out of said light beam path, and said light extracting means comprising a measurement field selector and a photodetector means for measuring luminous flux within a measurement field determined by said measurement field selector, said measurement field selector and said photodetector means being located in a light path of said subbeam, and a measurement field selecting adjustable collimator system arranged in the path of an uncollimated subbeam.

15. An X-ray examination apparatus comprising an X-ray image intensifier tube having an exit screen and an optical beam transmission system arranged after said exit screen in the path of an image-carrying light beam, said optical beam transmission system comprising beam splitting means for projecting an output image onto a hard-copy device in one direction and onto a television camera tube in a second direction, and light extracting means arranged in the light beam path for controlling a brightness control device, characterized in that said light extracting means directs a subbeam containing image information from the whole of said exit screen into a third direction out of said light beam path, and said light extracting means comprising a measurement field selector and a photodetector means for measuring luminous flux within a measurement field determined by said measurement field selector, said measurement field selector and said photodetector means being located in a light path of said subbeam, and second beam splitting means for directing light from said exit screen toward said photodetector means and for directing light from a light source toward said exit screen.

* * * * *